US005702324A

United States Patent [19]

Wendel et al.

[11] Patent Number: 5,702,324

[45] Date of Patent: Dec. 30, 1997

[54] WRIST EXTENSOR EXERCISE DEVICE

[76] Inventors: Patricia A. Wendel; Lawrence D. Wendel, both of 3020 Barnwood Crossing, Duluth, Ga. 30155

[21] Appl. No.: 726,388

[22] Filed: Oct. 4, 1996

[51] Int. Cl.[6] ..... A63B 23/14

[52] U.S. Cl. ..... 482/46; 601/33

[58] Field of Search ..... 482/44, 45, 46, 482/47, 48, 49; 602/1, 2; 601/33, 40; 84/465

[56] References Cited

U.S. PATENT DOCUMENTS

| | | | |
|---|---|---|---|
| 5,100,126 | 3/1992 | Liou | 482/46 |
| 5,111,810 | 5/1992 | Fortney | 602/2 |
| 5,165,402 | 11/1992 | McCoy | 602/2 |
| 5,271,617 | 12/1993 | Gilford | 482/45 |
| 5,364,323 | 11/1994 | Liu | 601/40 |
| 5,415,624 | 5/1995 | Williams | 602/2 |
| 5,425,690 | 6/1995 | Chang | 482/46 |
| 5,454,769 | 10/1995 | Chew | 482/46 |
| 5,458,560 | 10/1995 | Kaiser | 601/33 |

*Primary Examiner*—Richard J. Apley
*Assistant Examiner*—William LaMarca
*Attorney, Agent, or Firm*—James B. Middleton

[57] ABSTRACT

A wrist exerciser has a rigid platform to receive a person's wrist, and a fabric support to hold the wrist to the rigid platform. A hinged arm is pivoted to the rigid platform and is fixed to the fabric support at the palm of the hand, so that as the hand is moved in the extension direction, the hinged arm moves. A rod is pivoted to the hinged arm so that, as the hinged arm moves, the rod moves proximally of the person's arm. A spring resists the motion of the rod, so the exercise is against spring tension. A heated or cooled pad can be placed in the arm support to provide therapy during exercise.

10 Claims, 2 Drawing Sheets

Fig. 1
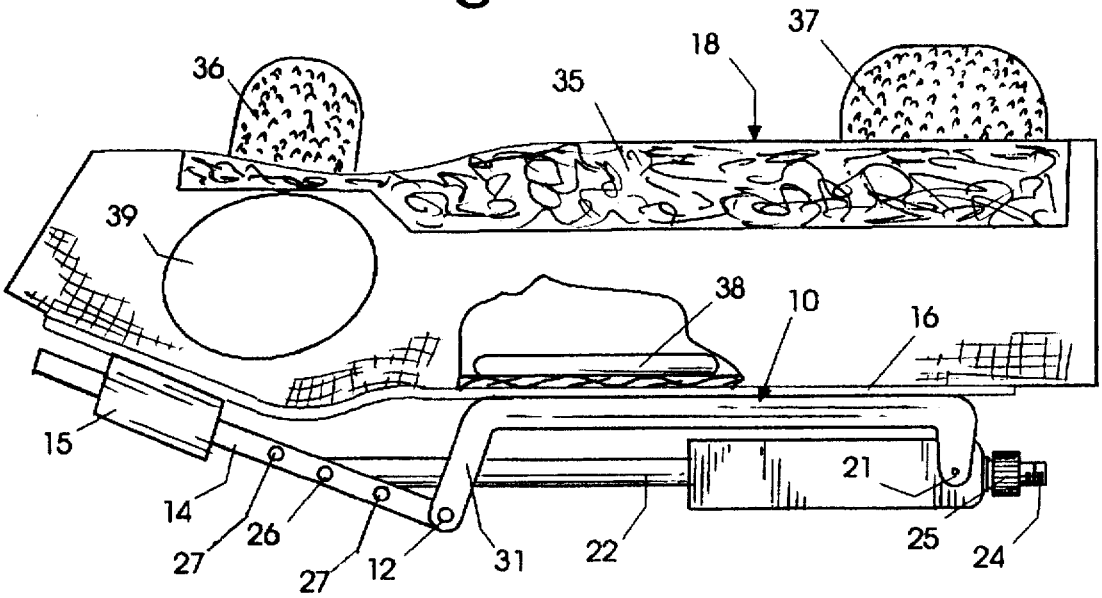
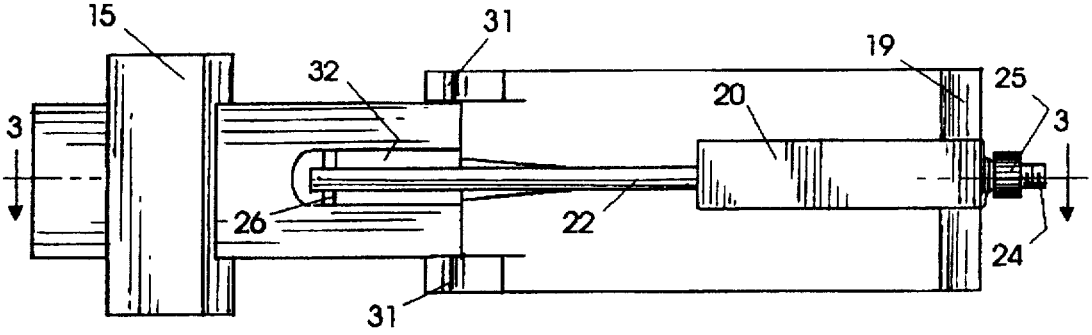
Fig. 2

WRIST EXTENSOR EXERCISE DEVICE

BACKGROUND OF THE INVENTION

1. Field of the Invention

This invention relates generally to exercising apparatus, and is more particularly concerned with a device for exercising the wrist extensor muscles.

2. Discussion of the Prior Art

In a person's normal life, one generally uses the wrist and hand muscles to close the hand, and/or to move the hand with respect to the wrist in the direction of the palm, more than the opposite, thereby building up the flexor muscles while not properly exercising the extensor muscles. This normal tendency is greatly exaggerated for people who have jobs requiring constant and repeated flexing of the fingers and hand.

In spite of the common problem wherein the flexor muscles are frequently exercised and the extensor muscles are infrequently exercised, there has been little done to remedy the defect. U.S. Pat. No. 4,815,729 to Stefanski discloses an elastic member that tends to hold the fingers inwardly, so one utilizes the extensor muscles to move the fingers outwardly against the tension. This device, however, provides no exercise for the wrist. Similarly, U.S. Pat. No. 1,879,401 to Monaco discloses apparatus intended to rehabilitate a hand, and requires only extension motion of the fingers. Thus, the prior art has not provided means to exercise the extensor muscles of the wrist.

SUMMARY OF THE INVENTION

The present invention provides means for stabilizing, or immobilizing, the wrist with a small angle of extension. A variable resistance is provided against which one can exercise the extensor muscles. The resistance is preferably sufficiently variable to allow proper exercise regardless of the strength of the person using the device. Also, when used therapeutically, means are provided for supplying heat or cold to the palm side of the wrist.

In a preferred embodiment of the invention, the wrist is fixed to a rigid member while the hand is fixed to a hinged arm that is hinged to the rigid member. Spring means act as resistance to movement of the arm. Preferably, the hand is fixed to the hinged arm, and the forearm of the person proximally of the carpals of the wrist, is fixed to the rigid member, allowing unobstructed motion of the wrist.

BRIEF DESCRIPTION OF THE DRAWINGS

These and other features and advantages of the present invention will become apparent from consideration of the following specification when taken in conjunction with the accompanying drawings in which:

FIG. 1 is a side elevational view of an exercise device made in accordance with the present invention;

FIG. 2 is a bottom plan view of the device shown in FIG. 1, the arm support being omitted for clarity; and, FIG. 3 is an enlarged cross-sectional view taken along the line 3—3 in FIG. 2.

DETAILED DESCRIPTION OF THE EMBODIMENT

Figure 3:
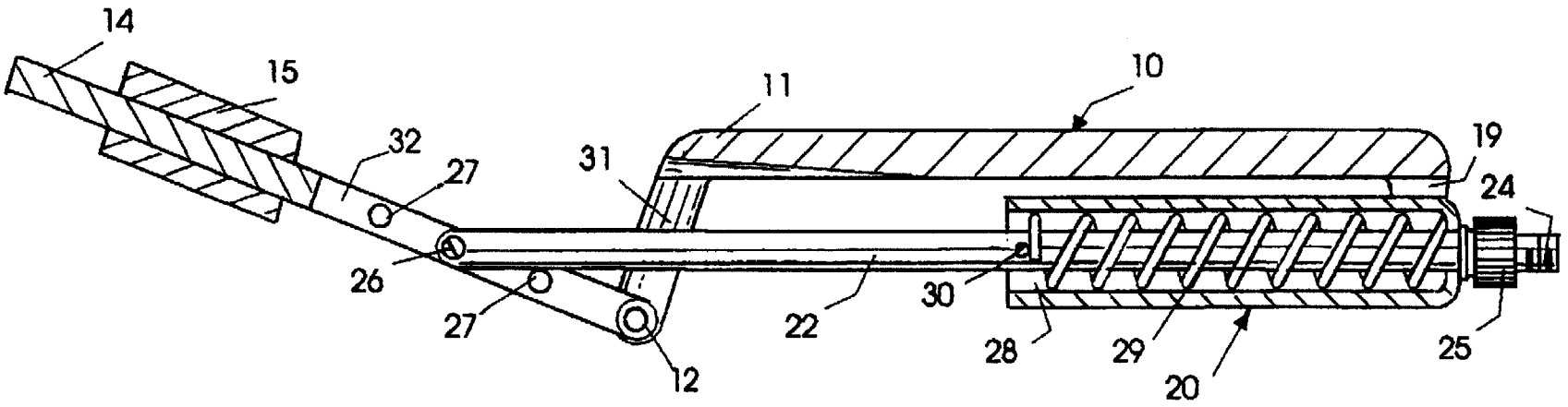

Carpal tunnel syndrome has been increasing in about the last ten years among both computer users and production line workers. It is thought that the repetitive flexing of the fingers and wrist, thereby building up the flexor muscles without similarly building up the extensor muscles, is at least a contributing cause of carpal tunnel syndrome. The imbalance in the musculature tends to urge the carpals out of their proper positions, and this leads to the irritation of nerves and consequent pain. Therefore, if the flexor and extensor muscles are developed together to retain balance, carpal tunnel syndrome should be prevented. Also, regaining muscle balance should assist in reducing the problems of the syndrome. The present invention therefore provides an exercising device to exercise and strengthen the extensor muscles.

Turning now to the drawings, and to that embodiment of the invention here presented by way of illustration, FIG. 1 shows a rigid member 10 adapted to be fixed to the wrist of a person. The distal end (distally with respect to the person's arm) 11 is angled away from the person's arm to provide a hinge 12. A hinged arm 14 is pivotally fixed at the hinge 12, and a slide block 15 is slidably received on the hinged arm 14.

It will be noted that there is a flexible sheet of material 16 that extends the full length of the exercising device. The sheet 16 is fixed to the rigid member 10, and is fixed to the slide block 15. Though no particular fastening means is here shown, those skilled in the art will understand that the sheet 16 may be attached using glue, brads or rivets, screws or other well known fastening means. The sheet 16, then, serves as the base for the fabric arm support 18. Again, the arm support 18 may be attached to the sheet 16 by any conventional means. Further, screws, rivets or the like may be passed through both the arm support 18 and the sheet 16 to hold the assembly together with a single set of fasteners.

The proximal end of the rigid member 10 turns down, away from the sheet 16, to provide a pivot for a spring housing. As can be seen from FIG. 2 of the drawings, there is a flange 19 that extends the width of the rigid member 10, but defines a central opening for receiving the spring housing 20. Pins 21 provide for the desired pivoting motion. A rod 22 extends through the spring housing 20, extending out proximally at 24. The proximal end of the rod 22 is threaded to receive a nut 25, and the distal end of the rod 22 is pivotally fixed to the hinged arm 14, as at 26. Additional holes 27 are provided in the arm 14 to allow adjustment of the pivot 26.

From the discussion this far, it will be understood that, when the hand of a person is extended, the slide block 15 will be moved, pivoting the hinged arm 14 about the hinge 12. This will cause movement of the rod 22. With spring resistance to the movement of the rod 22, such motion will be a muscle developing exercise.

Looking now at FIGS. 2 and 3 in more detail it will be seen that the spring housing 20 defines a central opening 28 which receives a spring 29 surrounding the rod 22. A spring compressing means 30, here shown as a pin passing through the rod 22, will compress the spring 29 when the rod 22 moves to the right as viewed in FIG. 3. The proximal end of the spring housing 20 is closed to contain the spring 29, and has only one hole to allow the rod 22 to pass therethrough.

The distal end of the rigid member 10 defines a pair of ears for providing the hinge 12, as is best shown in FIGS. 2. The hinged arm 14, then, is received between the two ears 31. The arm 14 is bifurcated, providing a slot 32 to receive the rod 22. With the width of the arm 14 as shown, there will be good lateral stability of the hinge, so motion will be restricted to one plane.

The slide block 15 defines a central opening to receive the arm 14 therethrough. The fit should be snug enough to prevent undue "play", but the slide block 15 should slide easily with respect to the arm 14.

Returning to FIG. 1 of the drawings, it will be realized that the axis of rotation of the hinged arm 14 will be at the hinge 12. The axis of rotation of the slide block 15, however, will be substantially at the palmar side of the wrist of the person using the device. Thus, the arm 14 and the block 15 have different axes of rotation, and the block 15 must be slidable with respect to the arm 14.

To hold the exercising device to a person's arm, the arm support 18 has side walls for cradling the arm and hand of the person, with a hole 34 through which the thumb will extend. In the embodiment here shown, there is a large area of the arm support 18 covered by loop material 35 of hook and loop fasteners. Straps 36 and 37, having hook material thereon, can be attached anywhere along the loop material. It is preferred that the wrist of the person, at the carpals, remain unencumbered; thus, there is one strap 36 over the back of the hand, and another strap 37 proximally of the wrist.

When desired, heat or cold can be applied to the wrist of the person, in the area of the carpals. In FIG. 1, a portion of the arm support 18 is broken away to show the pad 38 disposed in the area of the carpals. Apparatus such as the pad 38 is well known in the art, and it comprises a sealed pouch that can be heated (for example, in a microwave oven) to provide heat therapy, or it can be cooled (for example, in a freezer) to provide cryotherapy.

With the device attached to a person as described above, it will be understood that the wrist cannot flex because the rod 22 is held in position by the nut 25, the hand being preferably held with an angle of extension of about two degrees. When the wrist is extended, however, the rod 22 will move, compressing the spring 29 as it does so. As a result, repeated extension of the hand will provide muscle building exercising. It will also be understood that the pivot 26 can be moved to one of the holes 27 to vary the force required, or the nut 25 can be tightened to increase the force required to compress the spring, and different springs can be installed for further variation of the spring pressure.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. An exercise device for exercising the extensor muscles of the wrist, said exercising device comprising a rigid member adaptable to be fixed to the palmer side of a user's wrist, a hinged arm pivotal with respect to said rigid member and extending adjacent to the palm of said user's hand, means for fixing said hinged arm to said user's hand, and resistance means for resiliently resisting motion of said hinged arm when said user's hand is moved to exercise the extensor muscles, and including a flexible arm support fixed to said rigid member and to said hinged arm, said flexible arm support constituting a means for fixing said rigid member to a user's wrist and said means for fixing said hinged arm to said user's hand.

2. An exercise device as claimed in claim 1, including a thermal treatment means disposed at said palmar side of the user's wrist.

3. An exercise device as claimed in claim 2, wherein said thermal treatment means is cooled to provide cryotherapy.

4. An exercise device as claimed in claim 1, wherein said flexible arm support includes a first strap across the back of the user's hand, and a second strap proximally of the user's wrist.

5. An exercise device as claimed in claim 1, further including a block received on said hinged arm, said block being movable with respect to said hinged arm, said block constituting said means for fixing said hinged arm to said user's hand.

6. An exercise device as claimed in claim 5, wherein said block defines an opening therethrough for slidably receiving said hinged arm.

7. An exercise device as claimed in claim 1, wherein said hinged arm is angularly related to said rigid member, further including a rod pivotally fixed to said hinged arm and extending generally parallel to said rigid member, and a spring means fixed with respect to said rigid member for resiliently resisting motion of said rod towards the proximal end of said rod.

8. An exercise device as claimed in claim 7, further including a spring housing having a proximal end pivoted to said rigid member, said spring housing defining a central opening, and a spring received within said central opening, said rod extending through said central opening and said spring, saidproximal end of said spring housing defining a hole for slidably receiving said rod therethrough, and stop means for limiting motion of said rod in the distal direction.

9. An exercise device as claimed in claim 1, further including a flexible arm support fixed to said rigid member and to said hinged arm, said arm support constituting a means for fixing said rigid member to a user's wrist and said means for fixing said hinged arm to said user's hand, said arm support including a first strap across the back of the user's hand and a second strap proximally of the user's wrist, thermal treatment means disposed at said palmar side of the wrist, said thermal treatment means being cooled to provide cryotherapy.

10. An exercise device as claimed in claim 1, further including a block received on said hinged arm, said block being movable with respect to said hinged arm, said block constituting said means for fixing said hinged arm to said user's hand, said block defining an opening therethrough for slidably receiving said hinged arm, said hinged arm being angularly related to said rigid member, and a rod pivotally fixed to said hinged arm and extending generally parallel to said rigid member, a spring means fixed with respect to said rigid member for resiliently resisting motion of said rod towards the proximal end of said rod, and further including a spring housing having a proximal end pivoted to said rigid member, said spring housing defining a central opening, a spring constituting said spring means received within said central opening, said rod extending through said central opening and said spring, said proximal end of said spring housing defining a hole for slidably receiving said rod therethrough, and stop means for limiting motion of said rod in the distal direction.

* * * * *